US008235014B2

(12) United States Patent
Talan et al.

(10) Patent No.: US 8,235,014 B2
(45) Date of Patent: Aug. 7, 2012

(54) VALVE DRIVE OF AN INTERNAL COMBUSTION ENGINE

(75) Inventors: Georg Talan, Urbach (DE); Manfred Batzill, Neuhausen (DE); Dietmar Schwarzenthal, Ditzingen (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 436 days.

(21) Appl. No.: 12/543,101

(22) Filed: Aug. 18, 2009

(65) Prior Publication Data

US 2010/0126447 A1 May 27, 2010

(30) Foreign Application Priority Data

Nov. 27, 2008 (DE) ..... 10 2008 060 167

(51) Int. Cl.
*F01L 1/34* (2006.01)

(52) U.S. Cl. ..... 123/90.16; 123/90.15

(58) Field of Classification Search ..... 123/90.16, 123/90.24, 90.21, 90.15, 90.6
See application file for complete search history.

(56) References Cited

FOREIGN PATENT DOCUMENTS

| | | | |
|---|---|---|---|
| DE | 101 48 178 | A1 | 4/2003 |
| DE | 10 2007 037232 | A1 | 2/2009 |
| DE | 10 2007 054978 | A1 | 5/2009 |
| DE | 10 2007 062234 | A1 | 6/2009 |
| EP | 0 798 451 | B1 | 4/1999 |
| JP | 52044314 | A * | 4/1977 |

OTHER PUBLICATIONS

German Search Report, dated Nov. 24, 2009 (Appl. No. 10 2008 060 167.5).

German Search Report, dated Nov. 24, 2009 (Appl. No. 10 2008 060 170.5).

* cited by examiner

*Primary Examiner* — Zelalem Eshete

(74) *Attorney, Agent, or Firm* — RatnerPrestia

(57) ABSTRACT

A valve drive of an internal combustion engine, with a camshaft including cams for actuating gas-exchange valves, wherein at least one cam, which includes several cam faces, is guided nonrotatably but with freedom of axial movement on the camshaft; wherein a stroke profile, which cooperates with an actuating pin for the axial displacement of the cam or cam piece, is assigned to the associated axially displaceable cam or an axially displaceable cam piece comprising several cams; and wherein the stroke profile of the axially displaceable cam or cam piece in question includes intersecting stroke curves. A guide element is assigned to the end of the actuating pin which can be introduced into the stroke curve of the stroke profile of the associated axially displaceable cam or cam piece, this guide element being supported in such a way that it can rotate or pivot around the axis of the actuating pin.

10 Claims, 5 Drawing Sheets

VALVE DRIVE OF AN INTERNAL COMBUSTION ENGINE

CROSS REFERENCE TO RELATED APPLICATIONS

This U.S. patent application claims priority to German Application DE 10 2008 060 167.5, filed Nov. 27, 2008, which is incorporated by reference herein in its entirety.

FIELD OF THE INVENTION

The present invention pertains to a valve drive of an internal combustion engine.

BACKGROUND OF THE INVENTION

EP 0 798 451 B1 discloses a valve drive of an internal combustion engine with a camshaft, to which several cams, each of which actuates a gas exchange valve, are assigned. Each cam is supported nonrotatably on the camshaft but with the freedom to shift axially, wherein each cam comprises several cam faces arranged next to each other in the axial direction of the camshaft. Depending on the axial position of the cams on the camshaft, one of the cam faces of each cam is active and converts a rotational movement of the camshaft into stroking movements of a gas exchange valve. According to EP 0 798 451 B1, a stroke profile is formed on each of the two sides of each cam. An actuating pin cooperates with this profile to realize the axial displacement of each of the cams. By means of a stroke profile formed on the left side of a cam, the cam in question can be shifted axially to the left, and by means of a stroke profile formed on the right side of the cam, the cam in question can be shifted axially to the right. According to EP 0 798 451 B1, therefore, several stroke profiles and actuating pins are assigned to each cam to realize the ability to shift the cams along the camshaft.

A valve drive of an internal combustion engine, in which pairs of cams are combined into a cam piece so that they can be shifted jointly in the axial direction, is known from DE 101 48 178 A1. According to the prior art DE 101 48 178 A1, a stroke profile comprising intersecting stroke curves is assigned to the cam piece. An actuating pin cooperates with the stroke profile, which consists of two intersecting stroke curves, wherein, depending on which of the intersecting stroke curves of the stroke profile the actuating pin engages, the cam piece comprising several cams is shifted either axially to the left or axially to the right. By combining several cams into a cam piece, the number of stroke profiles can be reduced. Through the use of a stroke profile with intersecting stroke curves, the number of actuating pins required can be decreased.

When, in the case of the valve drive of DE 101 48 178 A1, an actuating pin travels through the area where the intersecting stroke curves intersect, the valve drive can malfunction, because there is the danger that the actuating pin can become jammed in the intersection area or, upon traveling through the intersection area, it can arrive in the area of the wrong stroke curve. This is disadvantageous. There is therefore a need for a valve drive by means of which such malfunctions can be reliably avoided.

SUMMARY OF THE INVENTION

Against this background, the present invention is based on the goal of creating a novel valve drive of an internal combustion engine.

This goal is achieved by a valve drive of an internal combustion engine. According to aspects of the invention, a guide element is assigned to the end of the actuating pin which can be introduced into the stroke curves of the stroke profile of the associated axially displaceable cam or cam piece. This guide element is supported on the end of the actuating pin in such a way that it can rotate or pivot around the axis of the actuating pin.

In accordance with aspects of the present invention, it is proposed that a guide element be assigned to the end of the actuating pin which can be introduced into the stroke curves of the stroke profile, wherein the guide element is rotatably supported on the end of the actuating pin, namely, in such a way that the guide element can rotate or pivot around the axis of the actuating pin. By means of a guide element such as this, it is possible to prevent the actuating pin from becoming jammed in the intersection area as it travels through the area where the stroke curves intersect. It is also possible to prevent the actuating pin from leaving the prescribed stroke curve of the stroke profile and unintentionally arriving in the other stroke curve of the stroke profile as it passes through the intersection area.

According to an advantageous elaboration of the invention, a restoring element is assigned to the guide element. When the guide element is not engaged in the stroke profile of the associated axially displaceable cam or cam profile, this restoring element aligns the guide element in such a way that the longitudinal axis of the guide element is parallel to the area where the guide element enters the stroke curves of the stroke profile.

BRIEF DESCRIPTION OF DRAWINGS

Preferred elaborations of the invention can be derived from the following description. Exemplary embodiments of the invention are explained on the basis of the drawing, but the invention is not to be considered limited to them.

DETAILED DESCRIPTION OF THE PREFERRED EMBODIMENTS

Figure 1:
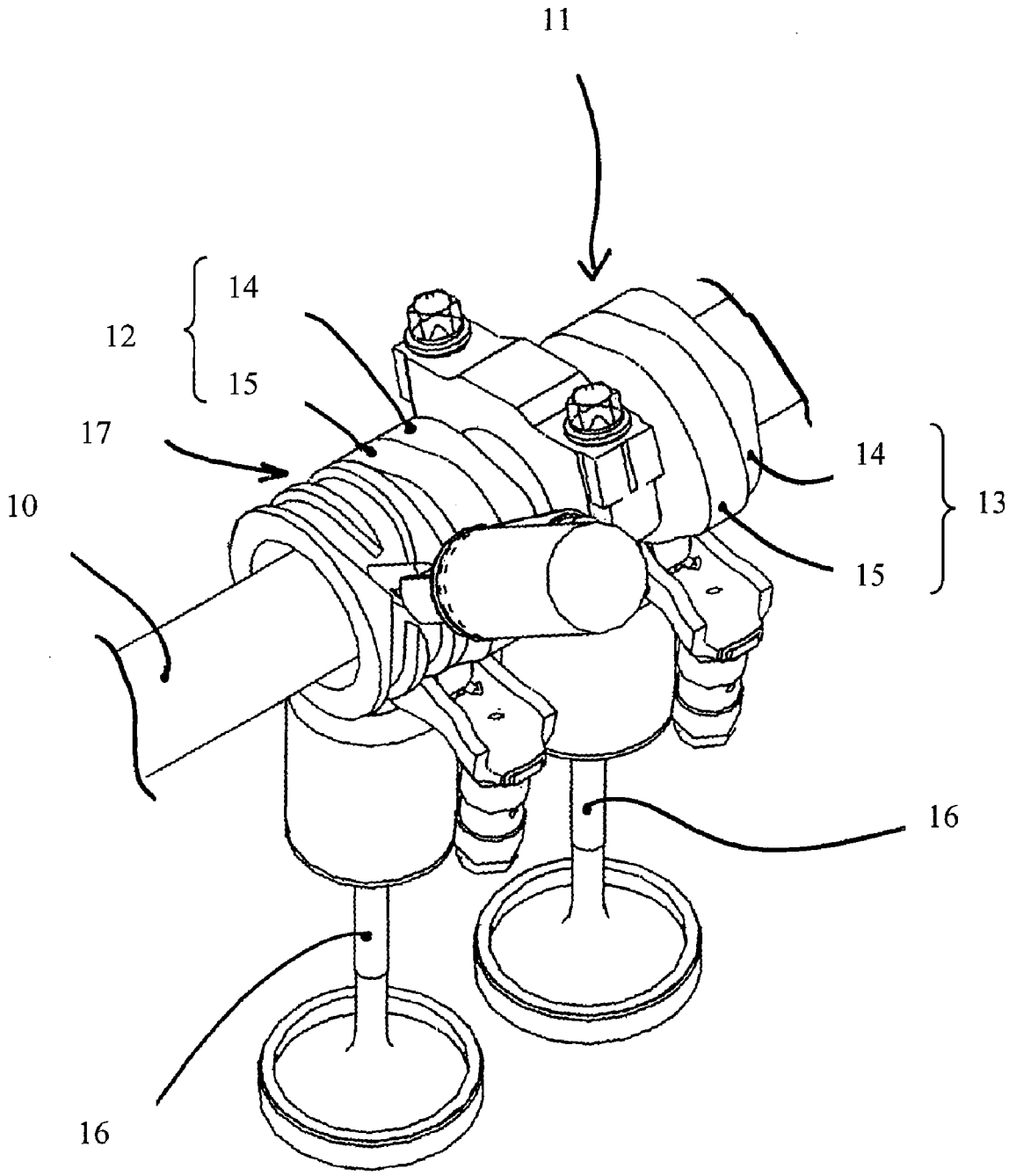
FIG. 1 shows a perspective view of part of an inventive valve drive of an internal combustion engine.

FIG. 1 shows part of an inventive valve drive of an internal combustion engine in the area of a cam piece 11, guided rotatably but with freedom of axial displacement on a camshaft 10, wherein the cam piece 11 comprises two cams 12, 13. Each cam 12, 13 of the axially displaceable cam piece 11 on the camshaft 10 has, in the exemplary embodiment shown here, two cam faces 14, 15, which are positioned one behind the other, i.e., next to each other, in the axial direction of the camshaft 10.

Each cam 12, 13 serves to actuate a gas-exchange valve 16, wherein the cams 12, 13 convert a rotational movement of the camshaft 10 into a stroking movement of the associated gas-exchange valve 16. An amplitude and/or phase position of the stroking movements of the gas-exchange valves 16 depends on the axial position which the cam piece 11 assumes on the camshaft 10 and on which cam face 14 or 15 of the cams 12, 13 serves to actuate the associated gas-exchange valve 16.

Figure 2:
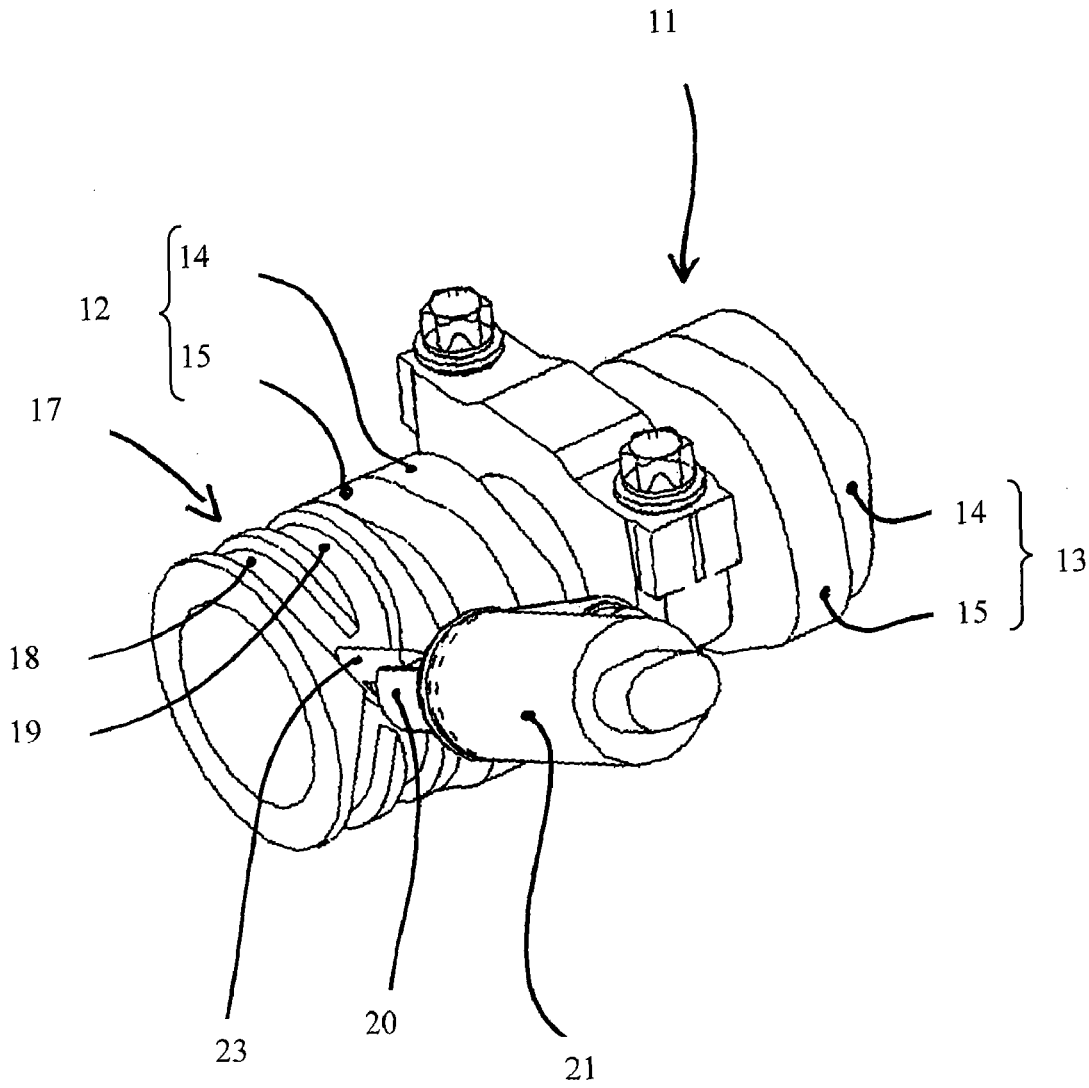
FIG. 2 shows perspective view of a detail of FIG. 1.
Figure 3:
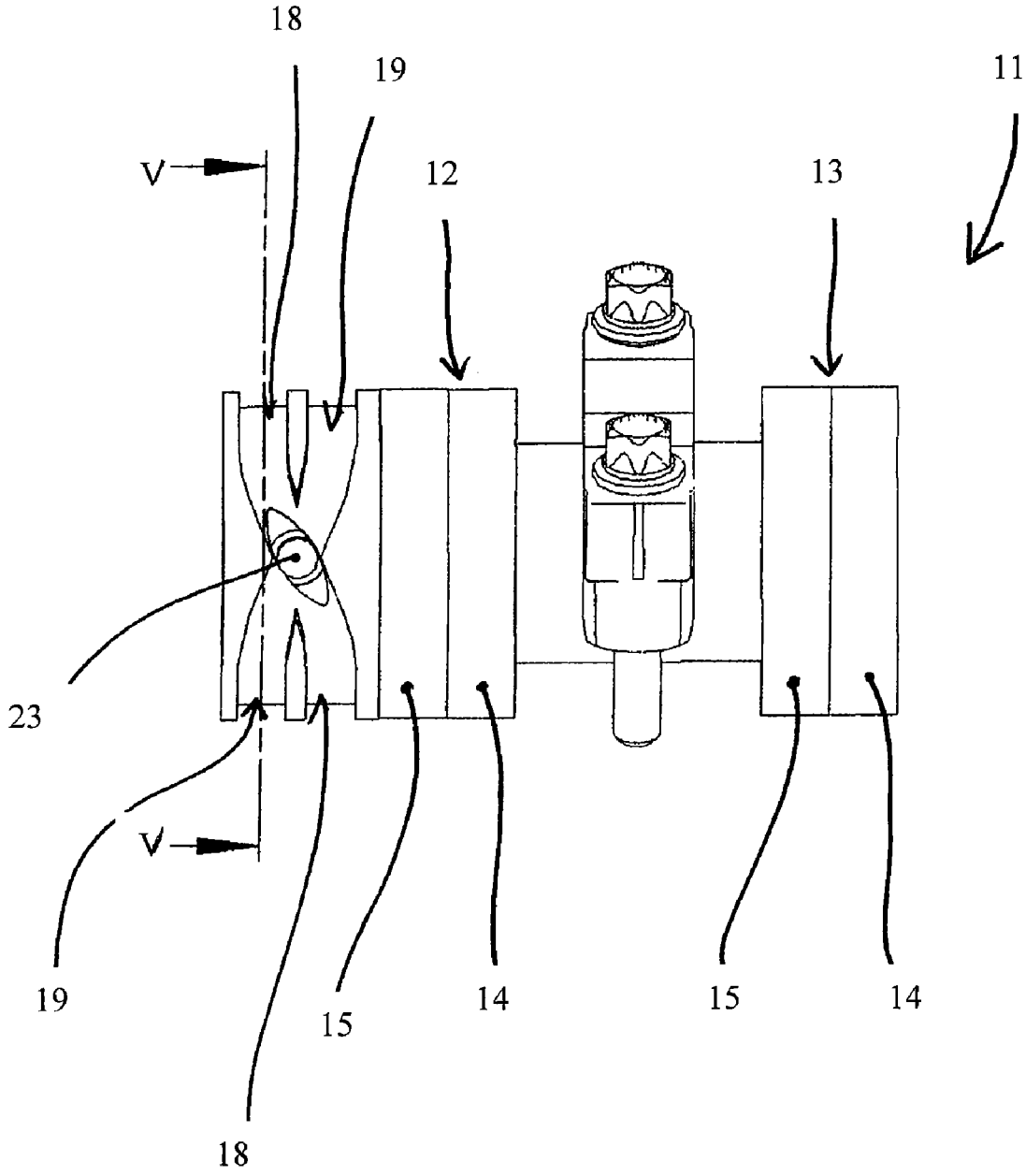
FIG. 3 shows a top view of the detail of FIG. 2.

According to FIGS. 1 and 2, a stroke profile 17 is assigned to the cam piece 11, i.e., to one side of that cam piece. This profile is formed by two intersecting stroke curves 18, 19. So that the cam piece 11 can be shifted axially, an actuating pin 20 (see FIG. 2) cooperates with the stroke profile 17, wherein the actuating pin 20 can be pushed by an actuator 21 in the axial direction of the actuating pin 20 and thus in the radial direction of the camshaft 10.

When the actuating pin 20 engages in a stroke curve 18 or 19 of the stroke profile 17 and the camshaft 10 is rotated, the cam piece 11 is pushed in the axial direction of the camshaft 10. The direction of this axial displacement depends on which stroke curve 18 or 19 of the stroke profile 17 the actuating pin 20 is engaging.

To prevent the actuating pin 20 from causing the valve drive to malfunction when the pin engages in the stroke profile 17 and travels through the intersection area 22 (see FIG. 4) of the stroke curves 18, 19 of the stroke profile 17, a guide element 23 is assigned to the end of the actuating pin 20 by which the pin can be introduced into the stroke curves 18, 19 of the stroke profile 17. The guide element 23 is supported rotatably in such a way on the end of the actuating pin 20 by which the pin can be introduced into the stroke curves 18, 19 of the stroke profile 17 that the guide element 23 can rotate or pivot around the axis of the actuating pin 20.

By means of the guide element 23, the actuating pin 20 can be prevented from becoming jammed in the intersection area 22 as it travels through the intersection area 22 of the stroke curves 18, 19 of the stroke profile 17. By means of the guide element 23, furthermore, it is possible to prevent the actuating pin 20 from leaving the prescribed stroke curve 18 or 19 and unintentionally arriving in the area of the other stroke curve 19 or 18 after the guide element 23 of the actuating pin 20 has been introduced into the stroke profile 17, namely, into one of the stroke curves 18, 19 of the profile, and then starts to travel through the intersection area 22 of the stroke curves 18, 19. The functional reliability of valve drives can be increased in this way.

Figure 4:
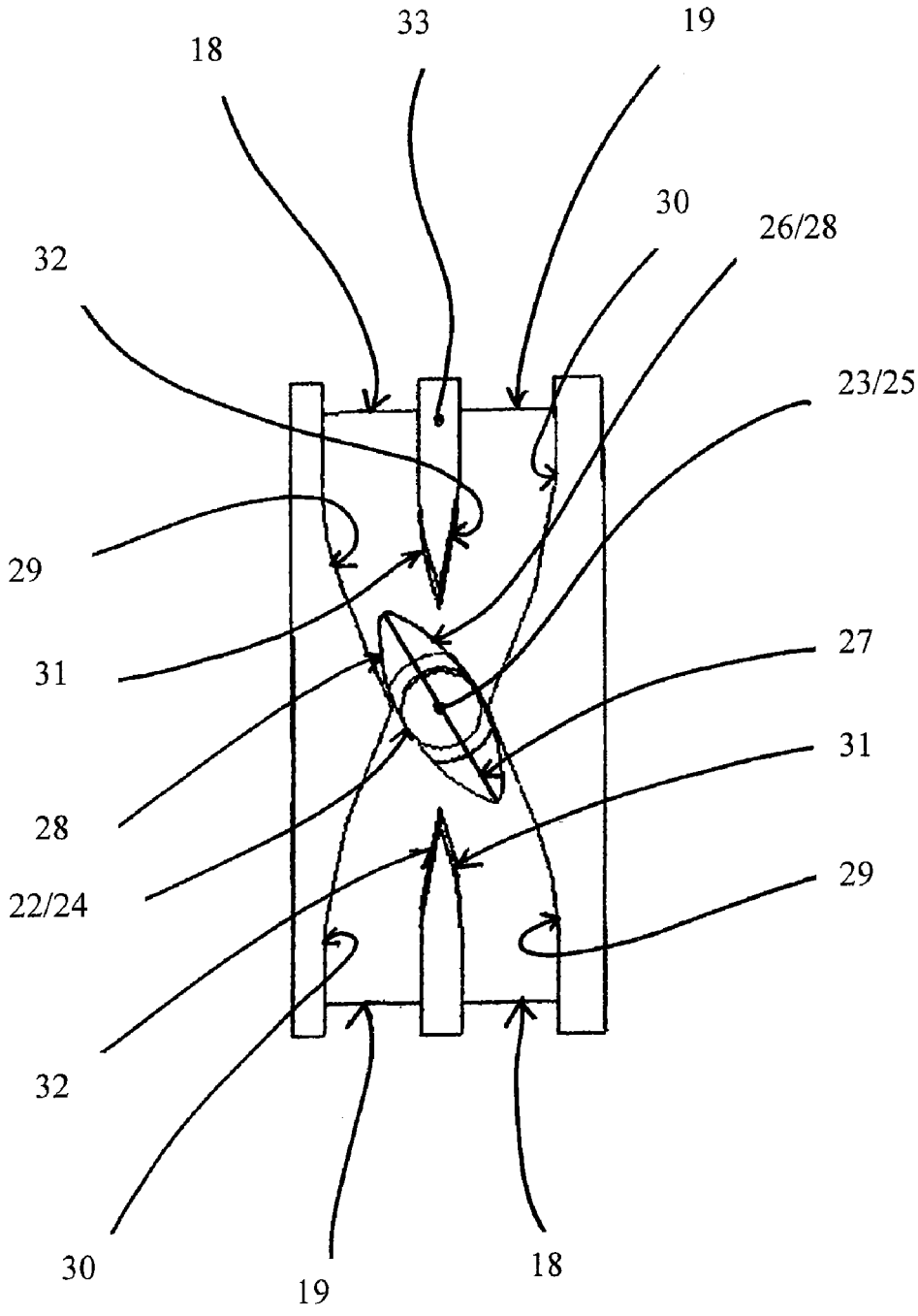
FIG. 4 shows an enlarged view of the detail of FIG. 3.
Figure 5:
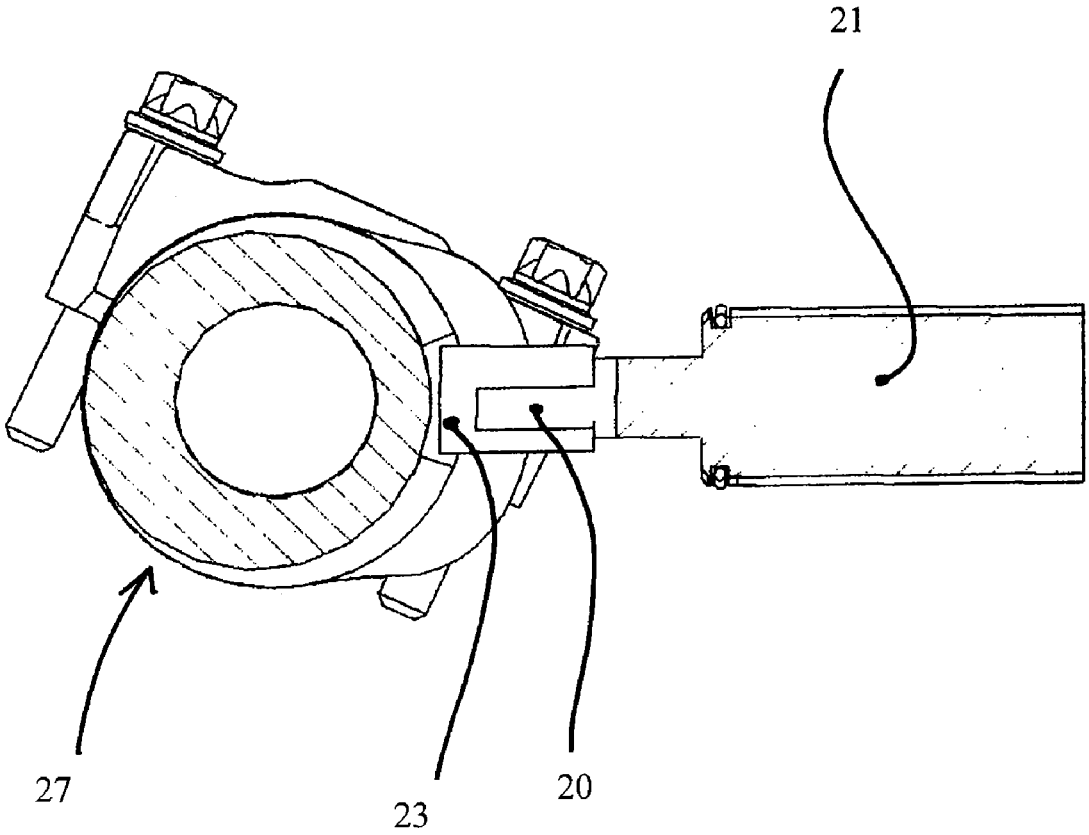
FIG. 5 shows a cross section through the detail of FIG. 3 along line V-V of FIG. 3.

As can be seen best in FIG. 4, the guide element 23 is contoured in such a way that, in its central area 24, through which the axis of rotation 25 of the element extends, it has a thickness which is adapted to the width of the stroke curves 18, 19 of the stroke profile 17. In the lateral areas 26, which, looking in the longitudinal direction 27 of the guide element 23, adjoin the central area 24 of the element, the guide element 23 comprises a lesser thickness, which decreases with increasing distance from the axis of rotation 25 of the element. As a result, convexly contoured side walls 28 of the guide element 23 are formed.

The guide element 23 comprises a length which is calculated in such a way that, when the central area 24 and thus the axis of rotation 25 of the element are located approximately in the middle of the intersection area 22 of the stroke curves 18, 19 of the stroke profile 17, the side walls 28 of the guide element 23 extending in the element's longitudinal direction rest against the outer boundary walls of the prescribed stroke curve 18 or 19 of the stroke profile 17, that is, against the outer boundary wall which, looking in the direction in which the guide element 23 moves, is located in front of the intersection area 22 and against the outer boundary wall which, looking in the direction in which the guide element 23 moves, is located behind the intersection area 22.

In FIG. 4, the actuating pin 20 with the guide element 23 assigned to it is intended to remain within the stroke curve 18 as it travels through the intersection area 22 of the stroke curves 18, 19, wherein the side walls 28 of the guide element 23 thus rest against the outer boundary walls 29 of the stroke curve 18. When, conversely, the guide element 23 and the actuating pin 20 are intended to travel along the stroke curve 19, the side walls 28 of the guide element will rest against the outer boundary walls 30 of that stroke curve 19.

The length of the guide element 23, furthermore, is calculated so that, when the central area 24 and thus the axis of rotation 25 of the element are located approximately in the middle of the intersection area 22 of the stroke curves 18, 19, an inner boundary wall of the prescribed stroke curve 18 or 19 to be traversed located in front of the intersection point 22 with respect to the direction in which the guide element 23 moves and an inner boundary wall located behind the intersection area 22 with respect to the direction of movement limit the ability of the guide element 23 to rotate.

When, as shown in FIG. 4, the guide element 23 is traveling along the stroke curve 18, the inner boundary walls 31 of the stroke curve 18 limit the rotatability or pivotability of the guide element 23 around the axis of rotation 25. If, however, the guide element 23 were to travel along the stroke curve 19, the inner boundary walls 32 of the stroke curve 19 would limit the rotatability or pivotability of the guide element 23.

The inner boundary walls 31 and 32 of the two stroke curves 18, 19, as shown in FIG. 4, form the boundaries of a web 33, by means of which the two stroke curves 18, 19 are separated from each other outside the intersection area 22.

According to an advantageous elaboration of the present invention, a restoring element (not shown) is assigned to the guide element 23. When the guide element 23 is not engaged in the stroke profile 17 and thus not into one of the stroke curves 18, 19, i.e. before the guide element has entered one of the stroke curves, the restoring element aligns the guide element 23 in such a way that the longitudinal axis 27 of the guide element is perpendicular to the axis of rotation of the camshaft 10, and so that the longitudinal axis 27 of the guide element 23 is therefore parallel to the area where the guide element 23 enters the stroke curves 18, 19. As a result, it can be guaranteed that the actuating pin 20 can always be introduced without difficulty into one of the stroke curves 18, 19 of the stroke profile 17.

While preferred embodiments of the invention have been described herein, it will be understood that such embodiments are provided by way of example only. Numerous variations, changes and substitutions will occur to those skilled in the art without departing from the spirit of the invention. It is intended that the appended claims cover all such variations as fall within the spirit and scope of the invention.

LIST OF REFERENCE NUMBERS

10 camshaft
11 cam piece
12 cam
13 cam
14 cam face
15 cam face
16 gas-exchange valve
17 stroke profile
18 stroke curve
19 stroke curve
20 actuating pin
21 actuator
22 intersection area
23 guide element
24 middle area
25 axis of rotation
26 lateral area
27 longitudinal axis
28 side wall
29 outer boundary wall

30 outer boundary wall
31 inner boundary wall
32 inner boundary wall
33 web

The invention claimed is:

1. A valve drive for an internal combustion engine including a camshaft comprising cams for actuating gas-exchange valves, wherein at least one axially displaceable cam, which comprises several cam faces, is guided nonrotatably but with freedom of axial movement on the camshaft, wherein a stroke profile, which cooperates with an actuating pin for axial displacement of the axially displaceable cam or cam piece, is associated with either said at least one axially displaceable cam or an axially displaceable cam piece comprising several cams, and wherein the stroke profile of said at least one axially displaceable cam or cam piece comprises at least one stroke curve, wherein a guide element is associated with an end of the actuating pin which is configured to be engaged with the stroke curve of the stroke profile of said at least one axially displaceable cam or cam piece, said guide element being supported in such a way that it is configured to either rotate or pivot around an axis of the actuating pin.

2. A valve drive according to claim 1, wherein the stroke profile comprises several stroke curves, which are configured such that the stroke curves merge with each other and/or intersect.

3. A valve drive according to claim 1 further comprising a restoring element assigned to the guide element, wherein when the guide element is not engaged with the stroke profile, the restoring element aligns the guide element in such a way that a longitudinal axis of the restoring element is substantially perpendicular to an axis of rotation of the camshaft.

4. A valve drive according to claim 2 further comprising a restoring element, wherein when the guide element is not engaged with the stroke profile, the restoring element aligns the guide element in such a way that a longitudinal axis of the restoring element is parallel to an area where the guide element enters the stroke curves.

5. A valve drive according to claim 1, wherein the guide element is contoured in such a way that, in a central area of the guide element through which an axis of rotation of the guide element extends, the guide element comprises a thickness which is adapted to a width of the stroke curves of the stroke profile.

6. A valve drive according to claim 5, wherein the guide element is contoured in such a way that, in lateral areas which, looking in a longitudinal direction of the guide element, adjoin the central area, the guide element comprises a thickness which decreases with increasing distance from an axis of rotation of the guide element.

7. A valve drive according to claim 2, wherein the actuating pin is configured to be guided without jamming in an intersection area of the stroke curves of the stroke profile.

8. A valve drive according to claim 7, wherein the guide element is configured in such a way that the actuating pin always remains in a prescribed stroke curve of the stroke profile even as it travels through the intersection area of the stroke curves of the stroke profile.

9. A valve drive according to claim 8, wherein the guide element comprises a length which is calculated in such a way that, when an axis of rotation of the guide element is located approximately in the middle of the intersection area of the stroke curves, side walls of the element extending in the longitudinal direction of the guide element rest against both an outer boundary wall of the prescribed stroke curve of the stroke profile located, looking in the direction in which the guide element moves, in front of the intersection area and an outer boundary wall located, looking in the direction in which the guide element moves, behind the intersection area.

10. A valve drive according to claim 8, wherein the guide element comprises a length which is calculated in such a way that, when the axis of rotation of the element is approximately in the middle of the intersection area of the stroke curves, an inner boundary wall of the prescribed stroke curve of the stroke profile located, looking in the direction in which the guide element moves, in front of the intersection area and an inner boundary wall located, looking in the direction in which the guide element moves, behind the intersection area, limit the ability of the guide element to rotate.

* * * * *